US010280857B2

(12) United States Patent
Ford et al.

(10) Patent No.: US 10,280,857 B2
(45) Date of Patent: May 7, 2019

(54) METHOD OF OPERATING AN ENGINE

(71) Applicant: Ford Global Technologies, LLC, Dearborn, MI (US)

(72) Inventors: Kim Ford, Basildon (GB); James Bromham, Trowbridge (GB); Matthew Allen Schneider, Aachen (DE)

(73) Assignee: Ford Global Technologies, LLC, Dearborn, MI (US)

( * ) Notice: Subject to any disclaimer, the term of this patent is extended or adjusted under 35 U.S.C. 154(b) by 289 days.

(21) Appl. No.: 15/243,564

(22) Filed: Aug. 22, 2016

(65) Prior Publication Data

US 2017/0058805 A1 Mar. 2, 2017

(30) Foreign Application Priority Data

Aug. 24, 2015 (GB) ..... 1514984.2
Oct. 19, 2015 (GB) ..... 1518452.6

(51) Int. Cl.
*F01N 3/08* (2006.01)
*F02B 75/18* (2006.01)
(Continued)

(52) U.S. Cl.
CPC ..... *F02D 41/0275* (2013.01); *F01N 3/0842* (2013.01); *F01N 3/0885* (2013.01);
(Continued)

(58) Field of Classification Search
CPC ..... F01N 3/0842; F01N 3/0885; F01N 2900/1602; F02B 75/18; F02D 41/0002;
(Continued)

(56) References Cited

U.S. PATENT DOCUMENTS 7,797,929 B2 9/2010 Elwart et al.
2002/0029562 A1 * 3/2002 Ishii ..... F01N 3/0842 60/277
(Continued)

FOREIGN PATENT DOCUMENTS

EP 2131029 A1 12/2009
GB 2350697 A 12/2000
(Continued)

OTHER PUBLICATIONS

Examination Report of Great Britain Patent Application No. 1514984.2, dated Feb. 24, 2016, 6 pages, United Kingdom Intellectual Property Office.
(Continued)

*Primary Examiner* — Brandon D Lee
(74) *Attorney, Agent, or Firm* — Julia Voutyras; McCoy Russell LLP

(57) ABSTRACT

Methods and systems are provided for regenerating a lean NOx trap. In one example, a method may include, responsive to an indication to regenerate a lean NOx trap (LNT), operating an engine with an overall rich air-fuel ratio to regenerate the LNT while minimizing fuel oil dilution by operating each cylinder of the engine with an alternating rich to lean air-fuel ratio pattern of two rich combustion events for every one lean combustion event across a plurality of engine cycles.

20 Claims, 4 Drawing Sheets

(51) Int. Cl.
*F02D 41/00* (2006.01)
*F02D 41/02* (2006.01)
*F02D 41/14* (2006.01)

(52) U.S. Cl.
CPC ..... *F02B 75/18* (2013.01); *F02D 41/0002* (2013.01); *F02D 41/008* (2013.01); *F02D 41/1454* (2013.01); *F01N 2900/1602* (2013.01); *F02D 41/1475* (2013.01); *F02D 2250/11* (2013.01)

(58) Field of Classification Search
CPC ..... F02D 41/008; F02D 41/0275; F02D 41/1454; F02D 2250/11; F02D 41/1475
See application file for complete search history.

(56) References Cited

U.S. PATENT DOCUMENTS

2004/0182069 A1 9/2004 Goralski, Jr. et al.
2005/0188685 A1 9/2005 Folliot et al.
2007/0051092 A1 3/2007 Pallett et al.
2008/0289318 A1* 11/2008 Elwart ..... F01N 3/0814 60/274
2014/0109553 A1 4/2014 Roberts, Jr. et al.
2014/0157760 A1 6/2014 Tufail et al.
2014/0170042 A1 6/2014 Kim

FOREIGN PATENT DOCUMENTS

GB 2351679 A 1/2001
GB 2352650 A 2/2001
GB 2355945 A 5/2001
GB 2426470 A * 11/2006 ..... F02D 41/008
WO 2008056826 A1 5/2008

OTHER PUBLICATIONS

Examination Report of Great Britain Patent Application No. 1518452.6, dated Apr. 20, 2016, 4 pages, United Kingdom Intellectual Property Office.

* cited by examiner

METHOD OF OPERATING AN ENGINE

CROSS REFERENCE TO RELATED APPLICATIONS

This application claims priority to Great Britain Patent Application No. 1514984.2, filed Aug. 24, 2015, and to Great Britain Patent Application No. 1518452.6, filed Oct. 19, 2015, the entire contents of each of which are hereby incorporated by reference for all purposes.

FIELD

This disclosure relates to operating an internal combustion engine and in particular to a method of operating an engine in order to facilitate regeneration of a lean NOx trap.

BACKGROUND/SUMMARY

In the field of lean-burn internal combustion engines, reduction of NOx, such as NO and NO2, in exhaust gas is a well-known problem. It is well known to use a Lean NOx Trap (LNT) in the exhaust system for adsorbing NOx when the engine is run lean and when the amount of NOx stored in the LNT reaches a predefined level to convert the stored NOx into N2 (nitrogen gas) during a NOx purge regeneration process in which the engine is run rich.

The term 'lean' as meant herein means an air-fuel ratio (lambda) above stoichiometry (where lambda at stoichiometry is equal to 1), that is to say, above the stoichiometric air-fuel ratio, where the production of HC (hydrocarbons) and CO (carbon oxides) are low and where the production of NOx is high. The term 'rich' as meant herein means an air-fuel ratio value with a lambda below 1 where the production of HC and CO used as reductants in the regeneration process is high and where the production of NOx and level of 02 are relatively low.

After completion of the NOx purge regeneration process the engine is run lean again and NOx is again adsorbed in the LNT.

The optimum NOx conversion temperature for a LNT NOx purge is dependent on several factors, such as the composition of the fuel used, the LNT construction in terms of the materials used, and the age of the LNT. However, in general terms, the optimum NOx conversion temperature value lies in a temperature region where optimum conversion of NOx into N2 is possible.

The temperature of exhaust gas supplied to a LNT varies and is generally increased when the rotational speed of the engine increases, when the load on the engine is increased, and in particular when the engine is run rich.

The inventors herein have recognized that one problem with known LNT NOx purge methods occurs when the engine is being run in a condition where the temperature of the exhaust gas flowing to the LNT is well below the optimum NOx conversion temperature, such as can often occur during light duty running such as urban or city driving.

If the temperature of the LNT is below an optimum temperature range of circa 300 to 400° C. and the NOx purge regeneration process starts by running the engine rich, then NOx will be released or purged from the LNT but, because the catalyst materials contained within the LNT are not active at such a low temperatures, the released NOx cannot be converted and will result in a sudden large increase in the NOx emissions from the tailpipe. It is therefore desirable to increase the temperature of the exhaust gas flowing to the LNT before starting the NOx purge regeneration process if the temperature of the LNT is below the optimum range if a sudden increase in NOx emissions is to be avoided.

Another factor affecting the performance of an LNT is sulfur poisoning of the LNT in which active sites within the LNT are poisoned by sulfur. Sulfur poisoning occurs when the engine is operated with fuel containing sulfur and an accumulation of the sulfur contaminant builds up in the LNT and causes a decrease in the amount of NOx the LNT can absorb. In order to remove the sulfur contaminant the LNT may be regenerated in what is known as a DeSOx purge regeneration (desulphation). In a DeSOx purge regeneration the temperature of the LNT is increased to circa 675° C. and the sulfur contaminant is burned off. One known method for raising the temperature of the LNT from its usual operating temperature to the temperature required for purging it of sulfur employs the combination of the hot DPF regeneration mode in which no feedgas EGR NOx control is employed and the rich calibration used also for the DeNOx purge. However, this approach to SOx purging regeneration increases NOx emissions during the hot lean phases.

According to a first aspect of the disclosure there is provided a method of operating a multi-cylinder lean burn engine arranged to supply exhaust gas to a lean NOx trap. The method includes checking whether regeneration of the lean NOx trap is indicated and whether a current temperature of one of the lean NOx trap and exhaust gas supplied to the lean NOx trap is above a threshold temperature to permit efficient regeneration of the lean NOx trap. When regeneration of the lean NOx trap is indicated and the current temperature of one of the lean NOx trap and the exhaust gas supplied to the lean NOx trap is not above the threshold, the method includes operating the engine in a lean NOx trap heating mode in which at least one cylinder of the engine is operated rich of stoichiometric in order to increase the temperature of the lean NOx trap and at the same time operating at least one of the remaining cylinders of the engine lean of stoichiometric. The method further includes, when the temperature of one of the lean NOx trap and the exhaust gas supplied to the lean NOx trap is above the threshold temperature, regenerating the lean NOx trap. During the lean NOx trap heating mode, the number of cylinders of the engine operated rich and the respective air-fuel ratio of the mixture supplied to the rich cylinders of the engine and the number of cylinders of the engine operated lean and the respective air-fuel ratio of the mixture supplied to the lean cylinders of the engine are set so as to produce the demanded air-fuel ratio of the exhaust gas flowing to the lean NOx trap and to meet a current torque demand for the engine and the at least one cylinder of the engine that is operated rich is changed in a sequential manner so that all of the cylinders of the engine are operated rich at some time during the period of time in which the engine is operated in the lean NOx trap heating mode.

The engine may have more than two cylinders, more than one cylinder of the engine may be operated rich, and more than one air-fuel ratio may be used for the cylinders of the engine operating rich. The engine may have more than two cylinders, more than one cylinder of the engine may be operated lean, and more than one air-fuel ratio may be used for the cylinders of the engine operating lean. Operating the engine in the lean NOx trap heating mode may result in an air-fuel lambda ratio of the exhaust gas flowing to the lean NOx trap that is not less than one.

Regenerating the lean NOx trap may comprise heating the lean NOx trap to a temperature high enough to permit efficient NOx purge regeneration of the lean NOx trap (e.g., to the threshold temperature or higher) and supplying exhaust gas to the lean NOx trap having an air-fuel ratio less than one. Alternatively, regenerating the lean NOx trap may comprise heating the lean NOx trap to a temperature high enough to permit efficient DeSOx purge regeneration of the lean NOx trap and switching the air-fuel lambda ratio of the exhaust gas flowing to the lean NOx trap between more than one and less than one in a cyclic manner during the DeSOx purge regeneration.

In another example, a method includes, responsive to an indication to regenerate a lean NOx trap (LNT), operating an engine with an overall rich air-fuel ratio to regenerate the LNT while minimizing fuel oil dilution by operating each cylinder of the engine with an alternating rich to lean air-fuel ratio pattern of two rich combustion events for every one lean combustion event across a plurality of engine cycles.

In this way, during the regeneration of the LNT, a similar pattern of alternating rich and lean combustion events may be employed to lower the air-fuel ratio, as needed to carry out the regeneration. However, by interrupting the rich combustion events with one or more lean combustion events, the amount of fuel that can accumulate on the cylinder walls may be reduced, thus lowering the dilution of the engine oil supply with fuel, as may frequently occur during continuous periods of rich operation.

It should be understood that the summary above is provided to introduce in simplified form a selection of concepts that are further described in the detailed description. It is not meant to identify key or essential features of the claimed subject matter, the scope of which is defined uniquely by the claims that follow the detailed description. Furthermore, the claimed subject matter is not limited to implementations that solve any disadvantages noted above or in any part of this disclosure.

DETAILED DESCRIPTION

Figure 1:
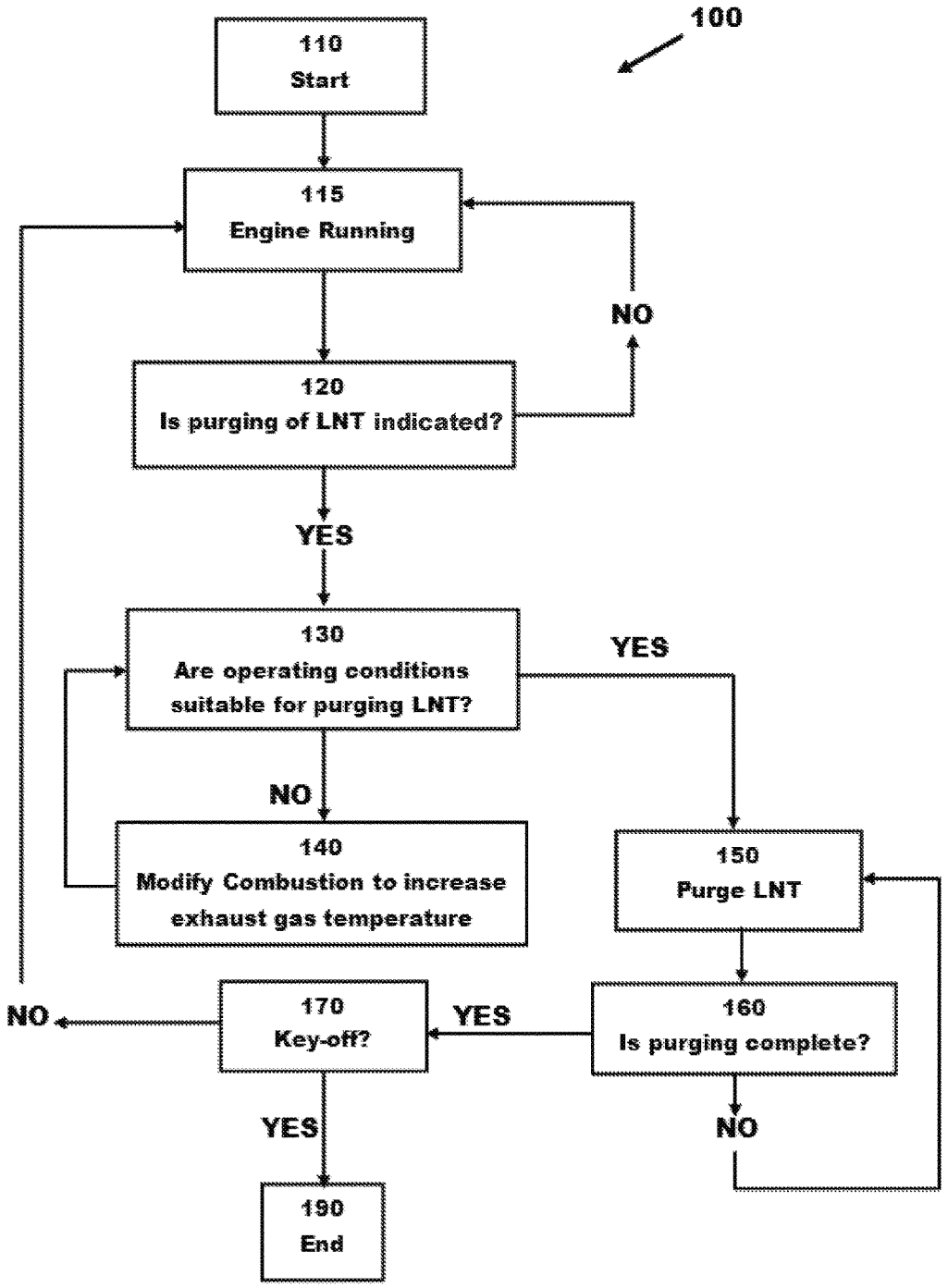
FIG. 1 is a high level flow chart of a method of operating a multi-cylinder lean burn engine in accordance with an aspect of the disclosure.

The following description relates to systems and methods for regenerating a lean NOx trap (LNT). An LNT may be regenerated (e.g., purged) responsive to a NOx storage capacity of the LNT being reached. To regenerate the LNT, rich exhaust gas is provided to the LNT, which causes the NOx stored in the LNT to be converted to nitrogen gas and oxygen, which are then released to the atmosphere. Because the rich exhaust gas increases fuel consumption, it may be desirable to perform the LNT regeneration as efficiently as possible. Efficient LNT regeneration may occur when the LNT is at a given operating temperature, such as 400° C. or higher. If regeneration is indicated but the LNT is not at the operating temperature, rich engine operation may result in heating of the LNT, but during the heating of the LNT, stored NOx may be released from the LNT without undergoing conversion, thus compromising emissions.

Thus, when regeneration of the LNT is desired but the LNT is below its operating temperature (e.g., less than 400° C.), the engine may be operated in an LNT heating mode where some cylinders of the engine are operated rich while other cylinders are operated lean. During the LNT heating mode, the overall exhaust gas air-fuel ratio at the LNT may be maintained at or above stoichiometry, thus preventing release of NOx from the LNT. However, due to some of the cylinders being operated rich, the temperature of the LNT may be increased up to the operating temperature. Once the LNT operating temperature is reached, the engine may be operated with an overall rich air-fuel ratio of exhaust gas at the LNT to perform the regeneration.

During the regeneration, the rich operation of the engine may result in excess fuel being provided to the cylinders. This fuel may accumulate on the cylinder walls and may eventually collect in the engine oil sump, where the fuel may dilute the engine oil supply, diminishing the lubricating properties of the oil and potentially causing engine or engine component degradation if the oil supply is not changed. Thus, to minimize the amount of fuel that may accumulate on the cylinder walls during an LNT regeneration, the regeneration may be carried out while the engine is operating with a rich to lean alternating combustion event pattern. Similar to the LNT heating mode described above, the alternating rich-lean combustion event pattern may include some cylinders operating with rich combustion while other cylinders operate with lean combustion, over a single engine cycle and across a plurality of engine cycles.

During the LNT heating mode, it is desirable if the overall exhaust gas air-fuel ratio is maintained at stoichiometry or lean of stoichiometry, to prevent release of NOx. As such, during the LNT heating mode, more cylinders may be operated lean than are operated rich during a given engine cycle. However, the alternating pattern employed during regeneration may include more cylinders being operated rich than are operated lean during a given engine cycle, to maintain an overall rich exhaust gas air-fuel ratio.

According to an aspect of the disclosure there is provided a motor vehicle having an engine arranged to supply exhaust gas to a lean NOx trap, a fuel injection system to supply fuel to the engine, an air intake system to supply air to the engine and an electronic controller to control the operation of the engine. The electronic controller is configured to check whether regeneration of the lean NOx trap is indicated and whether a current temperature of one of the Lean NOx trap and exhaust gas supplied to the lean NOx trap is high enough to permit efficient regeneration of the lean NOx trap and, if regeneration of the lean NOx trap is indicated and the current temperature of one of the lean NOx trap and the exhaust gas supplied to the lean NOx trap is not high enough to permit efficient regeneration of the lean NOx trap, the electronic controller is configured to operate the engine in a lean NOx trap heating mode in which at least one cylinder of the engine is operated rich of stoichiometric in order to increase the temperature of the lean NOx trap and operating at the same time at least one of the remaining cylinders of the engine lean of stoichiometric. When the temperature of one of the lean NOx trap and the exhaust gas supplied to the lean NOx trap is high enough to permit efficient regeneration of the lean NOx trap, the electronic controller is further configured to control the operation of the engine to regenerate the lean NOx trap. The electronic controller is further configured to ensure that the number of cylinders of the engine operated rich and the respective air-fuel ratio of the mixture supplied to the rich cylinders of the engine and the number of cylinders of the engine operated lean and the respective air-fuel ratio of the mixture supplied to the lean cylinders of the engine are set so as to produce the demanded air-fuel ratio for the exhaust gas flowing to the lean NOx trap. The electronic controller is further configured to meet a current torque demand for the engine and to change the at least one cylinder of the engine that is operated rich in a sequential manner so that all of the cylinders of the engine are operated rich at some time during the period of time in which the engine is operated in the lean NOx trap heating mode.

The engine may have more than two cylinders, more than one cylinder of the engine may be operated rich by the electronic controller, and more than one air-fuel ratio may be used for the cylinders of the engine operating rich. The engine may have more than two cylinders, more than one cylinder of the engine may be operated lean by the electronic controller, and more than one air-fuel ratio may be used for the cylinders of the engine operating lean. Operating the engine in the lean NOx trap heating mode may result in an air-fuel lambda ratio of the exhaust gas flowing to the lean NOx trap that is not less than one.

Regenerating the lean NOx trap may comprise heating the lean NOx trap to a temperature high enough to permit efficient NOx purge regeneration of the lean NOx trap and supplying exhaust gas to the lean NOx trap having an air-fuel ratio less than one. Alternatively, regenerating the lean NOx trap may comprise heating the lean NOx trap to a temperature high enough to permit efficient DeSOx purge regeneration of the lean NOx trap and switching the air-fuel lambda ratio of the exhaust gas flowing to the lean NOx trap between more than one and less than one in a cyclic manner during the DeSOx purge regeneration.

Figure 2:
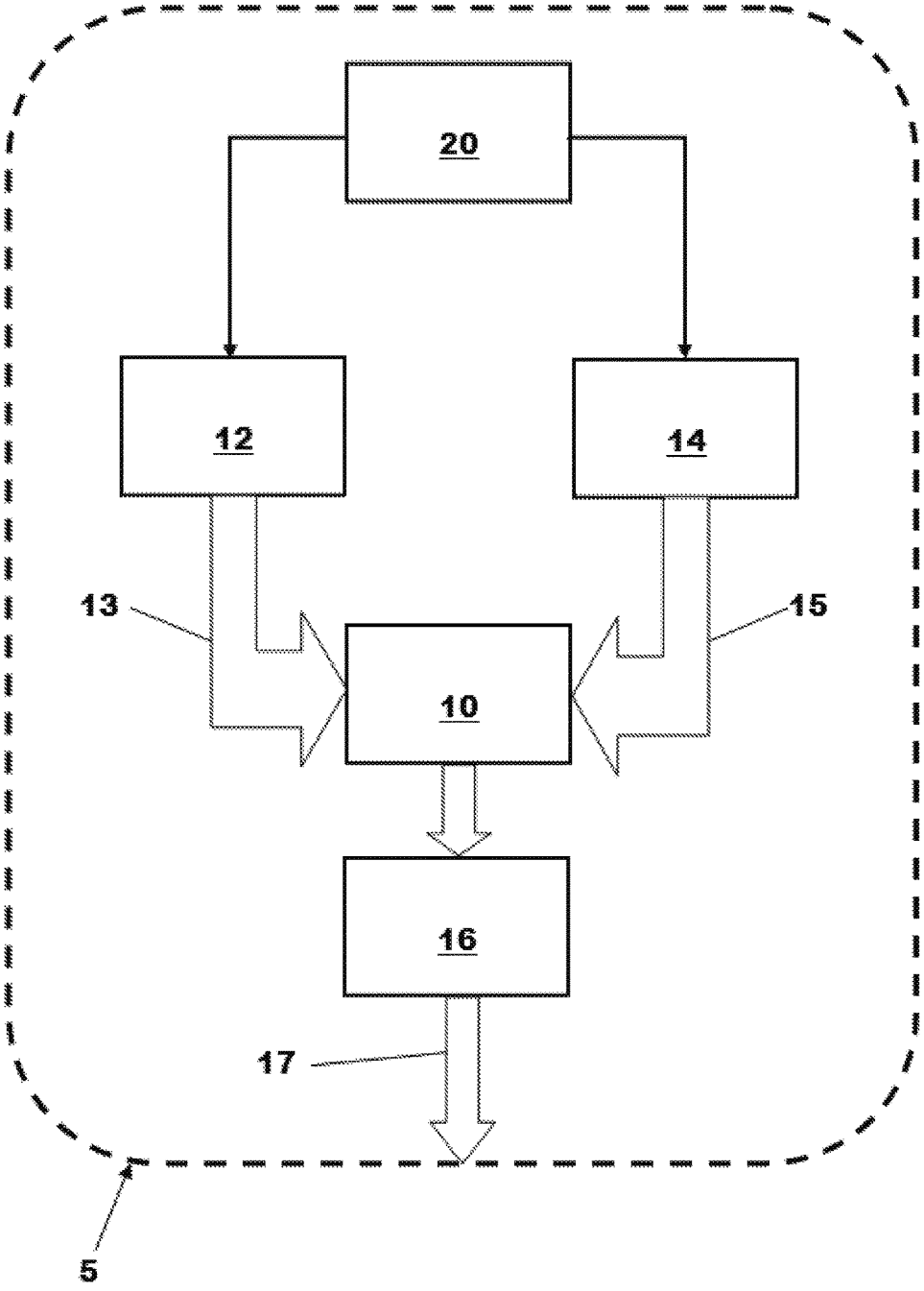
FIG. 2 is a schematic diagram of a motor vehicle having a multi-cylinder lean burn engine in accordance with an aspect of the disclosure.

With particular reference to FIG. 2 there is shown a motor vehicle 5 having a lean burn engine in the form of a multi-cylinder diesel engine 10. The engine 10 is supplied with fuel as indicated by the arrow 13 from a fuel injection system 12 and receives a supply of air as indicated by the arrow 15 from an air intake system 14. It will be appreciated that the air intake system could include one or more exhaust gas recirculation circuits and one or more devices to increase the pressure of the air entering the engine 10, such as a compressor of a supercharger or a compressor of a turbocharger.

An electronic controller 20 is used to control the operation of the engine 10 by controlling the fuel injection system 12 and the air intake system 14 as is well known in the art. The electronic controller may receive input data from the various sensors or buttons, process the input data, and trigger the actuators in response to the processed input data based on instructions or code programmed therein corresponding to one or more routines. Example control routines are described herein with regard to FIGS. 1 and 3. It will be appreciated that the electronic controller 20 could be formed from several separate controllers and need not be in the form of a single controller as shown in FIG. 2. It will be further appreciated that the electronic controller 20 is arranged to receive inputs from a number of sensors (not shown) in order to control the operation of the engine 10, such as but not limited to a mass airflow sensor (MAF), an accelerator pedal sensor, one or more exhaust gas NOx sensors, one or more Lambda sensors, and one or more temperature sensors including exhaust gas temperature sensors.

Exhaust gas flows out of the engine 10 to a lean NOx trap (LNT) 16 and then out to atmosphere as indicated by the arrow 17. It will be appreciated that other aftertreatment devices could be provided in the exhaust stream from the engine 10 to atmosphere, such as a diesel particulate trap (DPF).

The electronic controller 20 is configured to operate the engine 10 based upon the inputs it receives from the sensors in several modes of operation including a lean mode of operation, an LNT heating mode of operation, and at least one regeneration mode of operation. The electronic controller 20 receives signals from the various sensors of FIG. 2 and employs the various actuators of FIG. 2 to adjust engine operation based on the received signals and instructions stored on a memory of the controller.

In the lean mode of operation the air-fuel ratio of the mixture entering the engine 10 and the resulting exhaust gas (feedgas) supplied to the LNT 16 are both lean of stoichiometric, that is to say, the feedgas lambda is greater than 1. The engine 10 is operated whenever possible in the lean mode of operation because this maximizes fuel economy and minimizes HC and CO emissions.

In a NOx purge regeneration mode of operation the air-fuel ratio of the feedgas supplied to the LNT 16 is rich of stoichiometric that is to say, lambda is less than 1.

During the LNT heating mode of operation the air-fuel ratio of the feedgas supplied to the LNT 16 is lean of or close to stoichiometric and the LNT 16 needs to be heated gently so as not to produce a large increase in NOx emissions, but the air-fuel ratio of the mixture supplied to individual cylinders of the engine 10 is varied between rich and lean so as to produce the commanded feedgas lambda and the commanded torque output from the engine 10.

Thus, the electronic controller 20 is configured to operate a combination of lean and rich combustion regimes on different firing events and across different cylinders. For example and without limitation, in the case of a four cylinder engine have cylinders numbered 1 to 4, the cylinders 1 and 4 may be operated rich of stoichiometric for two combustion events so as to increase the temperature and reductants of the exhaust gas exiting these cylinders and hence increase the average temperature of the LNT and the exhaust gas flowing to the LNT 16, while the cylinders 2 and 3 are operated lean of stoichiometric for the same combustion events. The cylinders operated rich could then be reversed so that the cylinders 2 and 3 could be operated rich of stoichiometric for two combustion events so as to increase the temperature and reductants of the exhaust gas exiting these cylinders and hence increase the average temperature of the LNT and the exhaust gas flowing to the LNT 16 while the cylinders 1 and 4 are operated lean of stoichiometric for the same combustion events The net result of the rich and the lean combustion events is that a feedgas composition of the desired lambda (greater than one) is produced for the LNT 16 while at the same time the temperature of the feedgas and reductants supplied to the LNT 16 is rapidly increased, thus increasing the LNT temperature.

It will be appreciated that in the case of the cylinder or cylinders being operated lean, the fuel supply to the respective cylinder or cylinders could be temporarily cut-off resulting in a 100% lean mixture or the amount of fuel could be controlled to produce a mixture close to but lean of stoichiometric depending upon the mixture used for the cylinder or cylinders operated rich and the number of cylinders that are operated rich and lean.

Similarly, in the case of the cylinder or cylinders being operated rich the fuel supply to the respective cylinder or cylinders could be temporarily increased to the smoke limit or the amount of fuel could be controlled to produce a mixture close to but rich of stoichiometric depending upon the mixture used for the cylinder or cylinders operated lean and the number of cylinders that are operated rich and lean.

It will also be appreciated that every cylinder in the engine could be operated with a different lambda, with some being operated rich and some being operated lean.

Irrespective of the combination of rich and lean cylinders and the degree to which a cylinder is operated rich or lean, the combined torque output from all cylinders may be matched to meet the current torque demand from a driver of the motor vehicle 5.

With reference to FIG. 1 there is shown a method 100 of operating a multi-cylinder lean burn engine, such as the engine 10, to increase the temperature of feedgas entering a lean NOx trap, such as the LNT 16, thereby facilitating the regeneration of the LNT 16. Instructions for carrying out method 100 and the rest of the methods included herein may be executed by a controller, such as controller 20 of FIG. 2, based on instructions stored on a memory of the controller and in conjunction with signals received from sensors of the engine system, such as the sensors described above with reference to FIG. 1. The controller may employ engine actuators of the engine system to adjust engine operation, according to the methods described below.

In the case of this example the method 100 is applied to a NOx purge regeneration that increases the temperature of feedgas entering the LNT 16 without producing a large increase or spike in NOx emissions. It will be appreciated that the method could be embodied as a program in an electronic controller such as the electronic controller 20.

The method starts at 110, which is a 'key-on' event and then advances to 115 where the engine is running. It is to be understood that a key-on event may include alternate methods of starting an engine, such as a push-button, detection of a key fob, etc.

The method then advances from 115 to 120 to check whether regeneration of the LNT 16 is indicated. It will be appreciated that whether a NOx purge regeneration is indicated may be determined in many ways, such as by using a model of NOx production from the engine 10, by measuring NOx levels upstream and downstream of the LNT 16 using NOx sensors, or in another suitable manner.

If regeneration of the LNT 16 is not indicated, then the method returns to 115 with the engine 10 running. It will be appreciated that, although not shown, the method will end at any time if a key-off event such as the event indicated at 170 occurs.

If, when checked at 120, regeneration of the LNT 16 is indicated, the method advances to 130. In 130 it is checked whether the current engine operating conditions are suitable for efficiently regenerating the LNT 16. That is to say, a NOx purge regeneration can be conducted in an efficient manner. A lean NOx trap is efficiently regenerated when the process of NOx purge regeneration does not release a large amount of NOx from the LNT into the atmosphere.

An efficient NOx purge regeneration of the LNT 16 may be defined by a number of conditions, but the primary conditions may include whether the LNT temperature is sufficiently high that NOx can be liberated from the LNT 16 and the catalyst components of the LNT 16 are lit-up (e.g., LNT temperature above a first threshold temperature); and whether the feedgas lambda can be reduced sufficiently while meeting the current torque demand for the engine 10. That is to say, is the current engine torque demand is high enough to permit rich running of the engine 10 (e.g., engine torque demand greater than a threshold torque).

If both of these conditions are met the method advances to 150 where conventional regeneration of the LNT 16 commences and then advances to 160 to check whether the NOx purge regeneration is complete.

If, when checked in 160, the NOx purge regeneration is considered to be complete, the method advances to 170 where it is checked whether a 'key-off' event has occurred. If a 'key-off' event has occurred the method ends at 190 and, if a 'key-off' event has not occurred, the method returns to 115 with the engine running normally, e.g., to meet the current torque demand.

Referring back to 160, if the NOx purge regeneration is not complete the method returns to 150 and will loop around 150 and 160 until the LNT 16 has been sufficiently purged of NOx or NOx purge regeneration is no longer possible due to, for example, the engine 10 entering an idle state.

Referring back to 130, if the operating conditions are currently not suitable for NOx purge regeneration of the LNT 16, the method will advance from 130 to 140. The conditions not being suitable for NOx purge regeneration of the LNT at 130 may include the current LNT temperature being too low for effective regeneration of the LNT 16 because NOx cannot be released from the LNT 16 and too low to cause light-off of the catalyst materials in the LNT 16 (e.g., the temperature of the LNT being below a second threshold temperature, equal to or lower than the first threshold temperature).

At 140 the combustion of the engine 10 is modified to increase the temperature of the feedgas flowing to the LNT 16. This is done by operating at least one cylinder of the engine 10 rich while one or more other cylinders of the engine 10 are operated lean. The use of a rich mixture will result in the temperature and reductants of the exhaust gas exiting that cylinder increasing thereby increasing the resulting temperature of LNT 16.

The combination of rich and lean cylinders known as 'asymmetric combustion' is arranged so as to produce a feedgas lambda greater than 1 and so will not produce any significant release of NOx from the LNT 16.

The number of cylinders operating rich and lean will depend upon a number of factors including the number of cylinders present, the magnitude of heating requested, the current demand for torque, and the demanded feedgas lambda.

It will be appreciated that the cylinders operating rich could be cycled around the engine 10 as to even out the heating of the various cylinders thereby reducing thermal stress build-up in the engine 10.

It is not significant what sequence or cycling of rich and lean operating cylinders is used provided that sufficient LNT heating results, the current engine torque demand is met in an acceptable manner without large torque fluctuations, and the demanded lean or non-rich feedgas lambda is produced.

Referring back to 140, after the operating conditions have been modified, the method returns to check whether the conditions for NOx purge regeneration have now been met and will continue to cycle around 130 and 140 until the feedgas temperature has increased sufficiently to permit NOx purge regeneration without the production of unacceptably high NOx. That is to say, the feedgas temperature should be sufficiently high to light-up the catalytic materials of the LNT 16 and to facilitate the release of NOx from the LNT 16. It will be appreciated that, instead of using feedgas temperature, an LNT temperature model could be used to provide an estimate of the temperature within the LNT. The temperature within an LNT is normally higher than feedgas temperature due to heating that occurs within the LNT. The LNT temperature can then be used instead of exhaust gas temperature (feedgas temperature) for the test at 130.

The test at 130 could include a specific temperature test such as "Is T>Tmin" where T is either the temperature of the feedgas entering the LNT 16 or the temperature within the LNT 16 and Tmin is the minimum temperature for efficient LNT regeneration based upon whether the temperature is feedgas temperature or LNT temperature.

If when returning from 140 to 130, the result of the check is that LNT NOx purge regeneration can now be permitted, the method will advance from 130 to 150 and the engine 10 is operated rich to produce NOx purge regeneration of the LNT 16.

It will be appreciated that asymmetric combustion could also be used during the regeneration process to either vary the feedgas lambda between rich and lean or produce a rich feedgas while maintaining torque output, for example, operating at least one cylinder lean while operating other cylinders rich so as to produce the rich feedgas lambda and the high temperature for LNT regeneration.

From 150 the method advances as before via 160 to 170 when regeneration is complete. At 170 it is checked whether a 'key-off' event has occurred. If a 'key-off' event has occurred the method ends in 190 and, if a 'key-off' event has not occurred, the method returns from 170 to 115 with the engine running normally, e.g., to meet the current torque demand.

Therefore in summary, the disclosure provides a method in which a multi-cylinder lean burn engine is operated in a combination of combustion regimes that combine rich combustion events with lean combustion events that are torque matched, such that the sequence of rich and lean events for the cylinders are continuously variable between 100% lean to 100% rich. For example, a 25% rich event comprises one 10% rich combustion event and three 10% lean combustion events.

By using a net lean mode of operation having a mixture of rich combustion events, which supply heat to the LNT to bring it into its NOx reduction window, and lean combustion events, that increase the overall feedgas lambda, allows a subsequent rich purge to be more efficient.

It will be appreciated that not only can the number of cylinders that are operated rich or lean be varied but also the degree to which each cylinder is rich or lean may be varied. For example, in the case of a three cylinder engine, two cylinders could be operated 10% rich and a single cylinder could be operated 20% lean producing a feedgas lambda of circa 1.0.

It will also be appreciated that in the case of an engine having three or more cylinders, one or more cylinders could be operated rich, one or more cylinders could be operated lean, and one or more cylinders could be operated at stoichiometric.

Although the method 100 is described above with reference to a NOx purge regeneration it will be appreciated that it could be applied with benefit to a DeSOx purge with benefit. In such a case 110 and 115 are as previously described. At 120, the test is to determine whether the level of sulfur contamination is such that the purging of sulfur contaminants is indicated. One method for estimating the level of sulfur contamination is disclosed in U.S. Pat. No. 5,832,722, but it will be appreciated that other methods exist for making this determination or estimation and that the disclosure is not limited to the method disclosed in U.S. Pat. No. 5,832,722.

If DeSOx purge regeneration of the LNT 16 is not indicated, then the method returns to 115 with the engine 10 running. It will be appreciated that, although not shown, the method will end at any time if a key-off event such as the event indicated in 170 occurs.

If, when checked at 120, DeSOx purge regeneration of the LNT 16 is indicated, the method advances to 130. At 130 it is checked whether the current engine operating conditions are suitable for efficiently regenerating the LNT 16, e.g., if a DeSOx purge regeneration can be conducted in an efficient manner (which may include LNT temperature above a threshold temperature).

A DeSOx purge regeneration can be conducted in an efficient manner when the temperature is sufficiently high that fuel is not wasted trying to release SOx from the LNT in conditions that do not permit its release and combustion. A couple of conditions that may be present in order to efficiently carry out a DeSOx purge regeneration of the LNT 16 may include whether the exhaust gas temperature is sufficiently high that the sulfur can be liberated from the LNT 16, and whether the current engine torque demand is high enough to permit rich running of the engine 10.

If both of these conditions are met the method advances to 150 where DeSOx purge regeneration of the LNT 16 commences. In the case of this disclosure DeSOx purging is conducted by operating the engine 10 in an asymmetric combustion mode that produces alternating rich and lean feedgas mixtures for the LNT 16. When the engine is operated to produce a net lean feedgas the level of oxygen in the feedgas is increased, and when the engine 10 is operated to produce a net rich feedgas, the amount of oxygen is reduced but the amount of HC and CO is increased. The combination of these two conditions produces an exothermic reaction in the LNT 16, controls the temperature of the LNT 16 during the lean running, and releases the sulfur contaminants from the LNT 16 during the rich running.

For example and without limitation, the feedgas supplied to the LNT 16 could have a lambda less than one for between 5 and 15 seconds peaking at a lambda circa 0.95 and then the feedgas supplied to the LNT 16 could have a lambda more than one for between 5 and 15 seconds, peaking at a lambda circa 1.05.

With a conventional DeSOx using such a cyclic switching between rich and lean, all of the cylinders are operated either rich or lean to achieve the switching effect; however, by using asymmetric combustion this is not the case and some cylinders could be operated continuously lean while others cycle between lean and rich or between stoichiometric and rich or vice-versa. It will also be appreciated that, as previously described, the cylinders could be operated in a sequence or cyclic manner so as to even out temperature differences between the cylinders.

After 150, the method advances to 160 to check whether the DeSOx purge regeneration is complete. If, when checked in 160, the DeSOx purge regeneration is considered to be complete, the method advances to 170 where it is checked whether a 'key-off' event has occurred. If a 'key-off' event has occurred the method ends at 190 and, if a 'key-off' event has not occurred, the method returns to 115 with the engine running normally, e.g., to meet the current torque demand.

Referring back to 160, if the DeSOx purge regeneration is not complete the method returns to 150 and will loop around 150 and 160 until the LNT 16 has been sufficiently purged of sulfur contaminants or a DeSOx purge regeneration is no longer possible due to, for example, the engine 10 entering an idle state.

Referring back to 130, if the operating conditions are currently not suitable for a DeSOx purge regeneration of the LNT 16, the method will advance from 130 to 140. A failure of the test at 130 is primarily due to the current exhaust gas and/or LNT temperature being too low for effective DeSOx regeneration of the LNT 16 because sulfur cannot be released from the LNT 16.

At 140 the combustion of the engine 10 is modified to increase the temperature of the feedgas and reductants flowing to the LNT 16. This is done by operating at least one cylinder of the engine 10 rich while one or more other cylinders of the engine 10 are operated lean. The use of a rich mixture will result in the temperature of the exhaust gas exiting that cylinder increasing, thereby increasing the resulting temperature of the feedgas being supplied to the LNT and the exotherm within the LNT 16.

The combination of rich and lean cylinders known as 'asymmetric combustion' is arranged so as to produce a feedgas lambda greater than 1 and so will increase the temperature of the feedgas in a fuel efficient manner.

The number of cylinders operating rich and lean will depend upon a number of factors including the number of cylinders present, the magnitude of heating requested, the current demand for torque, and the demanded feedgas lambda.

As before, the cylinders operating rich could be cycled around the engine 10 as to even out the heating of the various cylinders thereby reducing thermal stress build-up in the engine 10 and the sequence or cycling of rich and lean operating cylinders used is not important provided sufficient LNT heating results and the current engine torque demand is met in an acceptable manner without large torque fluctuations.

Referring back to 140, after the operating conditions have been modified the method returns to check whether the conditions for DeSOx purge regeneration have now been met and will continue to cycle around 130 and 140 until the feedgas temperature has increased sufficiently to permit DeSOx purge regeneration.

It will be appreciated that, as previously referred to, instead of using feedgas temperature, an LNT temperature model could be used to provide an estimate of the temperature within the LNT. The temperature within an LNT is normally higher than feedgas temperature due to heating that occurs within the LNT. The LNT temperature can then be used instead of exhaust gas temperature (feedgas temperature) for the test at 130.

If when returning from 140 to 130 the result of the check is that DeSOx purge regeneration can now be permitted, the method will advance from 130 to 150 and the engine 10 is operated rich and lean to produce DeSOx purge regeneration of the LNT 16 as discussed with reference to 150.

From 150 the method advances as before via 160 to 170 when regeneration is complete. At 170 it is checked whether a 'key-off' event has occurred. If a 'key-off' event has occurred the method ends at 190 and, if a 'key-off' event has not occurred, the method returns from 170 to 115 with the engine running normally, e.g., to meet the current torque demand.

Therefore in summary by operating the engine in an asymmetric combustion mode heating of the exhaust gas and LNT can be achieved in an efficient manner for the purpose of NOx and sulfur purging of a lean NOx trap.

In the case of NOx purge regeneration, the temperature can be increased using asymmetric combustion without producing excess NOx during the period when the lean NOx trap is being heated.

In the case of DeSOx purge regeneration, the temperature can be increased using asymmetric combustion and then asymmetric combustion is used to perform a DeSOx regeneration in a fuel efficient manner to provide the cycling between rich and lean for removal of sulfur from the lean NOx trap without loss of feedgas NOx control.

In another example, the rich-lean cycling described above may be performed to reduce the dilution of the lubricating oil of the engine by fuel during rich running of the engine. As described above, it is well known to use an exhaust aftertreatment device such as a Lean NOx Trap (LNT) in an exhaust system of an engine for reducing the emissions from the engine entering the atmosphere. It is further known to operate an engine rich when it is indicated to regenerate a LNT in order to increase the temperature of the exhaust gas flowing to the device requiring regeneration and/or provide reductant to the LNT. It will be appreciated that rich combustion provides the reductants H, CO, and HC that are needed for the release and reduction processes within the LNT during a regeneration event.

Currently, the regeneration of an LNT to remove oxides of nitrogen (deNOx) or sulfur (deSOx) is performed relatively infrequently. For example, in a 90 minute period of engine running with a wide range of usage and/or conditions as few as three or four regeneration events may occur. However, future European emission legislation requires that the emissions produced on any real world drive cycle or reference cycle representing these real world cycles 'conform' with the emission limits legislated for the certification reference cycle so as to expand the usage region of controlled emissions to cover the range of customer use and conditions.

In order to meet these new emission requirements more frequent regeneration events (purges) will need to be scheduled in order to maintain aftertreatment device effectiveness at the required level. For example, a regeneration event may be required every four or five minutes of engine running. This increased frequency of regeneration events will significantly increase the rate at which engine oil dilution occurs due to the increased use of rich combustion events.

One problem with operating an engine rich for a sustained period of time is that unburnt fuel can accumulate on the upper cylinder walls of the engine. This accumulated fuel will tend to mix with the lubricating oil on the upper cylinder walls and will eventually be transferred to a sump of the engine. The transfer of fuel to the oil in this manner will dilute over time the lubrication oil of the engine in a process sometimes known as 'fuel in oil dilution' or 'engine oil dilution'.

Such engine oil dilution is problematic in that it can result in the viscosity of the lubricating oil being reduced potentially, resulting in lower oil pressure at high temperatures; the lubricating properties of the oil being reduced potentially, resulting in increased engine wear; increased volatility of the oil; an increased rate of oil oxidation; and increased engine corrosion. The result of the above is that the frequency of service intervals has to be increased if the rate of engine oil dilution is above a certain level.

Thus, according to another aspect of the disclosure, there is provided a method of reducing engine oil dilution during operation of a multi-cylinder lean burn engine arranged to supply exhaust gas to a lean NOx trap. The method includes, when regeneration of the lean NOx trap is indicated, the engine is operated in an asymmetric combustion mode in which at least one cylinder of the engine is operated rich and at least one of the remaining cylinders of the engine is operated lean and each cylinder is operated in an alternating rich and lean pattern so as to reduce the transfer of fuel into the oil of the engine. The engine may be operated in the asymmetric combustion mode for the duration of the regeneration.

The transfer of fuel into the oil may be reduced by eliminating the continuous rich running of any cylinder of the engine during the regeneration event. In an example, the alternating rich and lean pattern may comprise at least one rich combustion event followed by at least one lean combustion event. For example, the alternating rich and lean pattern may be one rich combustion event followed by one lean combustion event. Alternatively, the alternating rich and lean pattern may be two rich combustion events followed by one lean combustion event.

Each cylinder may be switched from lean operation to rich operation by increasing the mass of fuel supplied to the cylinder. Each cylinder may be switched from rich operation to lean operation by reducing the mass of fuel supplied to the cylinder. The cylinders of the engine that are operated rich and lean may be changed in a sequential pattern. All of the cylinders of the engine may be operated rich at some time during the regeneration of the lean NOx trap. All of the cylinders of the engine may be operated lean at some time during the regeneration of the lean NOx trap.

The number of cylinders of the engine operated rich and the respective air-fuel ratio of the mixture supplied to the rich cylinders of the engine and the number of cylinders of the engine operated lean and the respective air-fuel ratio of the mixture supplied to the lean cylinders of the engine may be set so as to produce a demanded air-fuel ratio of the exhaust gas flowing to the lean NOx trap and to meet a current torque demand for the engine.

According to another aspect of the disclosure, there is provided a motor vehicle having an engine arranged to supply exhaust gas to a lean NOx trap, a fuel injection system to supply fuel to the engine, an air intake system to supply air to the engine, and an electronic controller to control the operation of the engine. The electronic controller is configured to check whether regeneration of the lean NOx trap is indicated and, if regeneration of the lean NOx trap is indicated, the electronic controller is configured to operate the engine in an asymmetric combustion mode in which at least one cylinder of the engine is operated rich and operate at least one of the remaining cylinders of the engine lean, and each cylinder is operated in an alternating rich and lean pattern so as to reduce the transfer of fuel into the oil of the engine. The engine may be operated in the asymmetric combustion mode for the duration of the regeneration.

The transfer of fuel into the oil may be reduced by eliminating the continuous rich running of any cylinder of the engine during the regeneration event. The alternating rich and lean pattern may comprise at least one rich combustion event followed by at least one lean combustion event. For example, the alternating rich and lean pattern may be one rich combustion event followed by one lean combustion event. Alternatively, the alternating rich and lean pattern may be two rich combustion events followed by one lean combustion event.

The electronic controller may be configured to switch each cylinder from lean operation to rich operation by increasing the mass of fuel supplied to the cylinder. The electronic controller may be configured to switch each cylinder from rich operation to lean operation by reducing the mass of fuel supplied to the cylinder. The electronic controller may be configured to change in a sequential manner the at least one cylinder of the engine that is operated rich. The electronic controller may be further configured to control the engine so that all of the cylinders of the engine are operated rich at some time during the regeneration of the lean NOx trap. The electronic controller may be further configured to control the engine so that all of the cylinders of the engine are operated lean at some time during the regeneration of the lean NOx trap. The electronic controller may be configured to ensure that the number of cylinders of the engine operated rich and the respective air-fuel ratio of the mixture supplied to the rich cylinders of the engine and the number of cylinders of the engine operated lean and the respective air-fuel ratio of the mixture supplied to the lean cylinders of the engine are set so as to produce the demanded air-fuel ratio for the exhaust gas flowing to the lean NOx trap and is further configured to meet a current torque demand for the engine.

The term 'lean' as meant herein is an air-fuel ratio (lambda) above 1 and the term 'rich' as meant herein is an air-fuel ratio value with a lambda below 1. A stoichiometric air-fuel ratio has a lambda equal to 1. For a lean combustion event, more oxygen is present than is consumed by complete combustion of the supplied fuel; for a rich combustion event, more fuel is present than oxygen that is consumed by combustion of the supplied fuel.

The method of reducing oil dilution described herein may be performed in an engine system, such as that described above with respect to FIG. 2. It will be appreciated that the air intake system 14 of FIG. 2 may include a turbocharger or supercharger or combination thereof, a throttle and one or more exhaust gas recirculation (EGR) systems. These are used together to control the air flow path to the engine so as to regulate the mass flow of air and EGR entering the engine 10 and are referred to herein as 'airpath control'.

The electronic controller 20 is configured to operate the engine 10 based upon the inputs it receives from the sensors in several modes of operation including a lean mode of operation and at least one regeneration mode of operation. In the lean mode of operation the air-fuel ratio of the mixture entering the engine 10 and the resulting exhaust gas (feedgas) supplied to the LNT 16 are both lean of stoichiometric that is to say, the feedgas lambda is greater than 1. The engine 10 is operated whenever possible in the lean mode of operation because this maximizes fuel economy and minimizes HC and CO emissions.

In a regeneration mode of operation the air-fuel ratio of the feedgas supplied to the LNT 16 needs to be rich of stoichiometric that is to say, lambda less than 1. In order to achieve this in accordance with this disclosure the air-fuel ratio of the mixture supplied to individual cylinders of the engine 10 is changed or switched between rich and lean so as to produce the demanded feedgas lambda and the demanded torque output from the engine 10. That is to say, the electronic controller 20 is configured to operate a combination of lean and rich combustion regimes on different firing events and across different cylinders a process referred to herein as 'asymmetric combustion'.

For example and without limitation, in the case of a four cylinder engine have cylinders numbered 1 to 4, the cylinders 1 and 4 could be operated rich of stoichiometric for two combustion events while the cylinders 2 and 3 are operated lean of stoichiometric for the same combustion events. The cylinders operated rich could then be reversed so that the cylinders 2 and 3 could be operated rich of stoichiometric for two combustion events while the cylinders 1 and 4 are operated lean of stoichiometric for the same combustion events.

The net result of the rich and the lean combustion events is that a feedgas composition of the desired lambda (greater than one) is produced for the LNT 16 while at the same time the transfer of fuel to the upper part of the cylinders of the engine 10 is interrupted by switching from rich to lean combustion.

It will be appreciated that in the case of the cylinder or cylinders being operated lean the fuel supply to the respective cylinder or cylinders could be temporarily cut-off resulting in a 100% lean mixture or the amount of fuel could be controlled to produce a lean mixture. During the period of lean running any fuel transferred to the upper cylinder wall during a preceding period of rich running will likely evaporate or be combusted thereby reducing the quantity of fuel transferred to the lubricating oil of the engine 10.

In the case of the cylinder or cylinders being operated rich, the fuel supply to the respective cylinder or cylinders could be temporarily increased to the smoke limit or the amount of fuel could be controlled to produce a mixture close to but rich of stoichiometric depending upon the mixture used for the cylinder or cylinders operated lean and the number of cylinders that are operated rich and lean.

In one embodiment, airpath control is used to produce a lambda in all of the cylinders of the engine 10 close to but above 1.0 before asymmetric combustion commences. For example and without limitation, the lambda can be pre-set to 1.1, the switching from rich to lean can then be achieved very rapidly by only adjusting the amount of fuel supplied.

It will be appreciated that all of the cylinders are connected to a single air flow path and so by using airpath control to set the lambda for all cylinders slightly lean of stoichiometric, the switch from lean to rich for a specific cylinder can be achieved by simply increasing the fuel supplied to that cylinder so that the lambda decreases and by subsequently reducing the amount of fuel supplied to that cylinder will switch it back from rich to lean. For example and without limitation, the lambda can be toggled between, for example, 0.9 to 1.1 depending upon whether the cylinder is operating rich or lean.

It will also be appreciated that every cylinder in the engine could be operated with a different lambda with some being operated rich and some being operated lean.

Irrespective of the combination of rich and lean cylinders and the degree to which a cylinder is operated rich or lean the individual cylinders are torque matched and the combined torque output from all cylinders must be matched to meet the current torque demand from a driver of the motor vehicle 5.

By operating the engine 10 in this asymmetric combustion manner the process of fuel accumulating on the cylinder walls is interrupted and the result is that less fuel is transferred into the lubricating oil of the engine 10. That is to say, because each cylinder is operated rich and then lean or vice versa in an alternating sequence, the accumulation of fuel on the upper cylinders walls is considerably reduced.

It will be appreciated that in some cases a small number of combustion cycles or events such as one or two may be completed with a cylinder running rich and then a similar number of combustion cycles or events may be completed with the cylinder running lean. Alternatively, the cylinder may be operated rich and lean in an alternating consecutive pattern of one rich combustion event followed by one lean combustion event and vice-versa.

Figure 3:
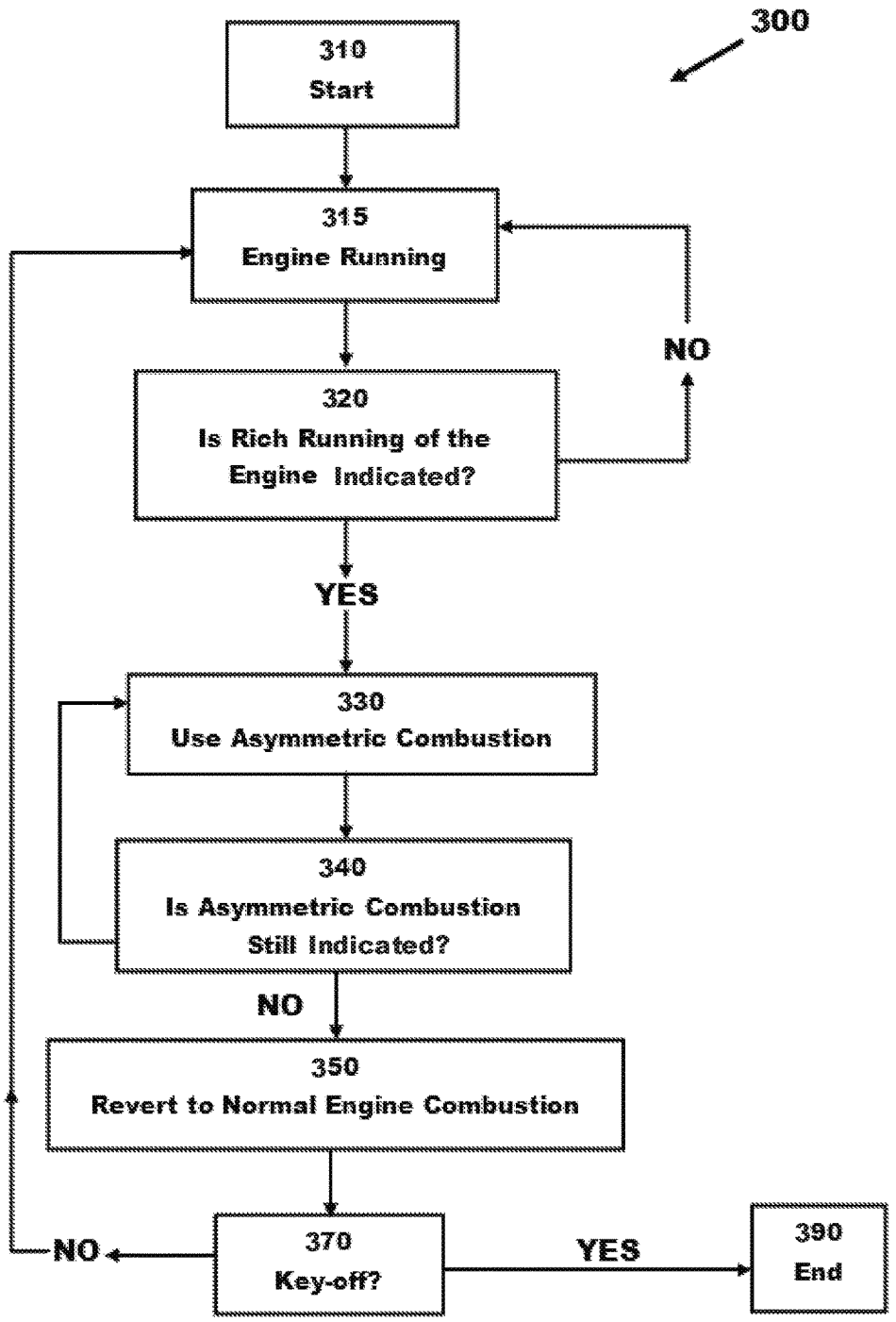
FIG. 3 is a high level flow chart of a method of reducing engine oil dilution in accordance with an aspect of the disclosure.

With reference to FIG. 3 there is shown a method 300 of reducing engine oil dilution when operating a multi-cylinder lean burn engine, such as the diesel engine 10, to produce a rich exhaust gas flow in order to regenerate a downstream LNT.

In the case of this example the method 300 is applied to a deNOx regeneration of the LNT 16 but it will be appreciated that it could be applied with equal merit to a deSOx regeneration of the LNT 16. It will further be appreciated that the method could be embodied as a program in an electronic controller such as the electronic controller 20.

The method starts at 310 which is a 'key-on' event and then advances to 115 where the engine is running. The method then advances from 115 to 120 to check whether rich running of the engine 10 is indicated in order to regenerate the LNT 16. In this case rich running is indicated when a deNOx regeneration is scheduled to occur and so the trigger for rich running is that a deNOx regeneration event is about to commence. It will be appreciated that whether a deNOx regeneration is indicated can be determined in many ways such as by using a model of NOx production from the engine 10, by measuring NOx levels upstream and downstream of the LNT 16 using NOx sensors, or in any other suitable manner.

If rich running of the engine 10 is not indicated, the method returns to 315 with the engine 10 running. It will be appreciated that at 315 the engine is running normally in order to meet current torque demands. It will be further appreciated that, although not shown, the method will end at any time if a key-off event such as the event indicated in 370 occurs. If, when checked at 320, rich running of the engine 10 to assist regeneration of the LNT 16 is indicated then the method advances to 330.

At 330 the engine 10 is operated in an asymmetric mode of combustion in which cylinders are operated in an alternating pattern of rich and lean combustion so as to reduce the transfer of fuel into the oil. The method then advances to 340 where it is checked whether asymmetric running is still indicated, that is to say, whether the regeneration event is continuing and, if it is, the method returns to 330.

If, when checked at 340, asymmetric running is no longer indicated because the regeneration event has ended or is scheduled to end imminently, the method advances from 340 to 350 where the engine 10 is operated normally in a symmetrical manner in which all of the cylinders operate with substantially the same lambda. The method then advances from 350 to 370 where it is checked whether a 'key-off' event has occurred. If a 'key-off' event has occurred the method ends at 390 and, if a 'key-off' event has not occurred, the method returns to 315 with the engine running normally, e.g., to meet the current torque demand.

The combination of rich and lean cylinder combustion known as 'asymmetric combustion' is arranged to break up the process of fuel accumulation on the upper cylinder walls when a cylinder is only run rich thereby reducing the transfer of fuel into the lubricating oil and hence reducing engine oil dilution. The number of cylinders operating rich and lean will depend upon a number of factors including but not limited to, the number of cylinders present, the current demand for torque, and the demanded feedgas lambda. It will be appreciated that the cylinders operating rich will be cycled around the engine 10 in a predefined sequence so as to break the pattern of fuel transfer to the oil of the engine 10.

The sequential or cyclic pattern of rich and lean operating cylinders used may be a suitable sequence or pattern to produce the desired LNT regeneration while reducing the transfer of fuel into the oil, provided that the current engine torque demand is met in an acceptable manner without large torque fluctuations.

It will be appreciated that asymmetric combustion can be used to vary the exhaust gas lambda between rich and lean or to produce a continuous rich exhaust gas flow while in both cases maintaining the torque output from the engine at a demanded level and interrupting the process of fuel transfer onto the upper cylinder walls of the engine 10.

Although not specifically shown at 330 on FIG. 3, as part of the method, the airpath may be pre-set to produce a combustion lambda in all of the cylinders of the engine 10 close to stoichiometric, for example, lambda 1.1, when asymmetric combustion is about to be used. By pre-setting the airpath in this manner, the switch to rich from lean combustion may be accomplished very rapidly by increasing only the amount of fuel supplied, and the switch from rich to lean by reducing the amount of fuel supplied. This is important because the switch from lean to rich or vice-versa has to be made rapidly and there is unlikely to be sufficient time to produce a stable change in air mass flow in such a short period of time.

Therefore in summary, the disclosure provides a method in which a multi-cylinder lean burn diesel engine is operated in a combination of combustion regimes that combine rich combustion events with lean combustion events that are torque matched. It will be appreciated that not only can the number of cylinders that are operated rich or lean be varied but also the degree to which each cylinder is rich or lean. For example, in the case of a three cylinder engine, two cylinders could be operated rich and a single cylinder could be operated lean in one combustion cycle producing the desired feedgas lambda and then for the next combustion cycle the cylinders operating rich and lean are changed. An example of such a sequence is shown in the following table referred to as Table 1.

TABLE 1

| Cycle | Cylinder 1 | Cylinder 2 | Cylinder 3 |
|---|---|---|---|
| 1 | Rich | Lean | Rich |
| 2 | Rich | Rich | Lean |
| 3 | Lean | Rich | Rich |
| 4 | Rich | Lean | Rich |
| 5 | Rich | Rich | Lean |
| 6 | Lean | Rich | Rich |
| 7 | Rich | Lean | Rich |

Although the method 300 is described above with reference to a NOx regeneration it will be appreciated that it could be applied with benefit to other events where the engine has to produce a rich exhaust gas flow for several combustion cycles such as for example a deSOx. Typically, a deNOx or deSOx regeneration event demands an engine to be run rich for a sustained period of time such as, for example and without limitation, five to six seconds.

Therefore in summary, the combination of rich and lean cylinder combustion known as 'asymmetric combustion' is arranged so as to break or interrupt the transfer of fuel onto the cylinders walls of the engine 10 that occurs during rich combustion events thereby resulting in a reduction of oil dilution and reducing the need for frequent oil changes in order to maintain effective engine lubrication.

Figure 4:
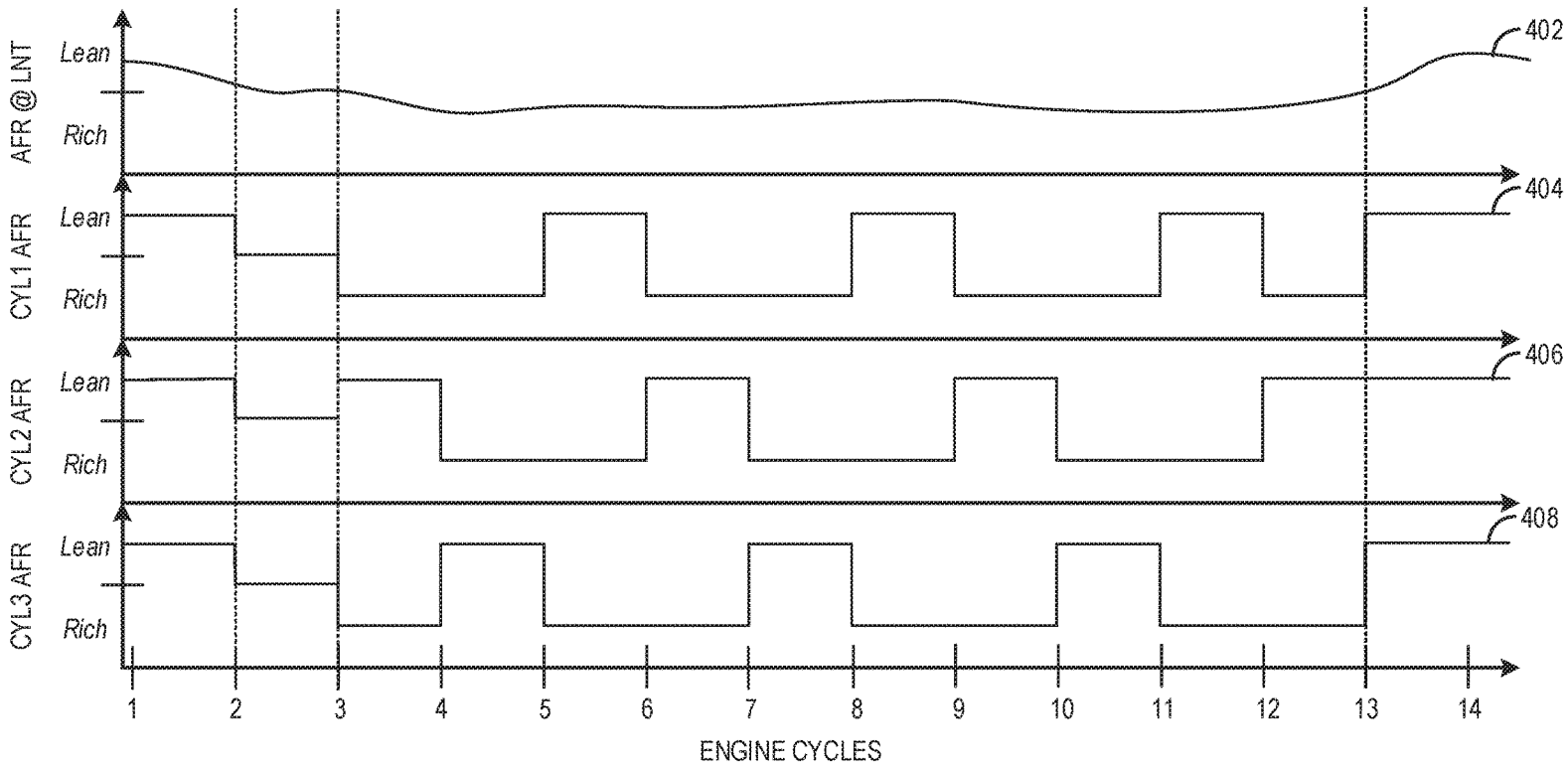
FIG. 4 is a diagram showing example operating parameters during a LNT regeneration.

Turning to FIG. 4, a diagram 400 of example operating parameters that may be observed during a lean NOx trap regeneration is illustrated. Diagram 400 includes overall engine air-fuel ratio, which may be the air-fuel ratio of the exhaust gas entering the LNT, illustrated by curve 402. Diagram 400 also shows the air-fuel ratio for each cylinder of an engine coupled to the LNT. Herein, the engine is a three-cylinder engine, though other engines could be used. The air-fuel ratio of a first cylinder is illustrated by curve 404, the air-fuel ratio of a second cylinder is illustrated by curve 406, and the air-fuel ratio of a third cylinder is illustrated by curve 408. For each plot, air-fuel ratio is plotted on the y-axis (vertical axis) as a function of engine cycles, plotted on the x-axis (horizontal axis). As used herein, an engine cycle includes two rotations of the crankshaft of the engine (e.g., from 0-720° CA) and each cylinder fires (e.g., undergoes a combustion event) one time during each engine cycle. As shown, the engine has a firing order of 1-2-3, although other firing orders are possible.

Prior to and during the first illustrated engine cycle, the engine operates with an overall air-fuel ratio that is lean, e.g., greater than stoichiometric. To achieve this, as shown, each of the first cylinder, second cylinder, and third cylinder is operated with a lean air-fuel ratio; during each combustion event for each cylinder during the first engine cycle, more oxygen is present than is consumed by the fuel during combustion.

At the start of the second engine cycle, an indication is output by the engine controller to regenerate the LNT. The LNT may be regenerated responsive to a NOx load on the LNT reaching a threshold, as estimated by operating conditions or measured by one or more sensors. To "pre-set" the engine for the regeneration, the engine is temporarily operated with a stoichiometric air-fuel ratio. To operate with the stoichiometric air-fuel ratio, the mass of intake air entering the engine may be reduced by adjusting an intake throttle position, for example, while the mass of fuel delivered to the cylinders may remain constant. As such, each cylinder operates with a stoichiometric air-fuel ratio for the second engine cycle.

At the beginning of the third engine cycle, the engine transitions to operate with the rich to lean alternating pattern of combustion events, in order to generate exhaust gas having an overall rich air-fuel ratio to initiate the regeneration while minimizing the amount of fuel transferred to the cylinder walls during the regeneration, thus reducing the fuel oil dilution. The rich to lean alternating pattern may include a suitable pattern of alternating rich combustion events and lean combustion events, where each cylinder is operated rich some of the time during regeneration and is also operated lean during some of the time during combustion, and where more rich combustion events occur than lean combustion events. As shown, the engine is operated with a pattern than includes two rich combustion events for every one lean combustion event over a plurality of engine cycles (e.g., nine of the engine cycles illustrated). Further, during each engine cycle of the regeneration, two cylinders are operated with a rich combustion event for every one cylinder that is operated with a lean combustion event. This two to one rich to lean pattern may ensure a rich enough exhaust gas is delivered to the LNT to initiate/sustain regeneration, while periodically interrupting the rich combustion events in each cylinder and on the engine as a whole to minimize the amount of fuel that may accumulate on the cylinder walls and eventually in the oil sump.

As shown, in the third engine cycle, the first cylinder is operated rich, the second cylinder is operated lean, and the third cylinder is operated rich. As used herein, a cylinder being operated rich includes the cylinder undergoing a combustion event with a rich air-fuel ratio (e.g., less than stoichiometric air-fuel ratio such that less oxygen is present than can be consumed by the fuel delivered to the cylinder). A cylinder being operated lean includes the cylinder undergoing a combustion event with a lean air-fuel ratio (e.g., greater than stoichiometric air-fuel ratio such that more oxygen is present than can be consumed by the fuel delivered to the cylinder). While each engine cycle is shown has having a discrete, continuous air-fuel ratio for each cylinder, it is to be understood that this for illustrative purposes and the rich or lean air-fuel ratio actually occurs once charge air has been inducted to the cylinder and the fuel has been delivered.

In the fourth engine cycle, which immediately follows the third engine cycle, the first cylinder is operated rich, the second cylinder is operated rich, and the third cylinder is operated lean. As such, the first cylinder remains at the rich air-fuel ratio while the second cylinder undergoes a lean to rich transition and the third cylinder undergoes a rich to lean transition. In the fifth engine cycle, which immediately follows the fourth engine cycle, the first cylinder is operated lean, the second cylinder is operated rich, and the third cylinder is operated rich. As such, the second and third cylinders remain at the rich air-fuel ratio while the first cylinder undergoes a rich to lean transition.

The pattern then repeats itself, whereby in the sixth engine cycle, the first cylinder is operated rich, the second cylinder is operated lean, and the third cylinder is operated rich; in the seventh engine cycle, the first cylinder is operated rich, the second cylinder is operated rich, and the third cylinder is operated lean; and in the eighth engine cycle, the first cylinder is operated lean, the second cylinder is operated rich, and the third cylinder is operated rich. The pattern, which extends over three engine cycles, is repeated iteratively until the regeneration ends, as shown at the beginning of the thirteenth engine cycle, when the air-fuel ratio is returned to lean for all the cylinders.

Thus, during regeneration of the LNT, the cylinders are operated with a rich to lean alternating pattern. As shown, the first cylinder is operated with a rich-rich-lean pattern, the second cylinder is operated with a lean-rich-rich pattern, and the third cylinder is operated with a rich-lean-rich pattern. Together, when the engine is fired in the 1-2-3 firing order, this results in an overall pattern of rich-lean-rich-rich-rich-lean-lean-rich-rich-rich-lean-rich-rich-rich-lean-lean-rich-rich, and so forth. The alternating pattern is such that no more than two lean combustion events occur consecutively and no more than three rich combustion events occur consecutively, for the engine as a whole.

In some examples, in order to maintain torque during the alternating rich to lean combustion event pattern, ignition timing may be adjusted differentially for the cylinders undergoing a lean combustion event versus the cylinders undergoing a rich combustion event. For example, spark timing or fuel injection timing may be retarded (e.g., delayed) during the rich combustion events relative to spark timing or fuel injection timing during the lean combustion events.

Thus, the systems and methods described herein provide for a method including responsive to an indication to regenerate a lean NOx trap (LNT), operating an engine with an overall rich air-fuel ratio to regenerate the LNT while minimizing fuel oil dilution by operating each cylinder of the engine with an alternating rich to lean air-fuel ratio pattern of two rich combustion events for every one lean combustion event across a plurality of engine cycles.

Operating the engine with the overall rich air-fuel ratio to regenerate the LNT may include, during each engine cycle where the engine is operated with the overall rich air-fuel ratio, operating two cylinders of the engine with a rich air-fuel ratio for every one cylinder of the engine operated with a lean air-fuel ratio. Operating each cylinder of the engine with the alternating rich to lean air-fuel ratio pattern may further include operating each cylinder of the engine such that consecutive lean combustion events for the engine as a whole are maintained under a first threshold and consecutive rich combustion events for the engine as a whole are maintained under a second threshold, higher than the first threshold. For example, the pattern may include no more than two lean combustion events in a row and no more than three rich combustion events in a row.

In an example, operating each cylinder of the engine with the alternating rich to lean air-fuel ratio pattern comprises: during a first engine cycle, operating a first cylinder of the engine with a rich combustion event, operating a second cylinder of the engine with a lean combustion event, and operating a third cylinder of the engine with a rich combustion event; during a second engine cycle immediately following the first engine cycle, operating the first cylinder of the engine with a rich combustion event, operating the second cylinder of the engine with a rich combustion event, and operating the third cylinder of the engine with a lean combustion event; and during a third engine cycle immediately following the second engine cycle, operating the first cylinder of the engine with a lean combustion event, operating the second cylinder of the engine with a rich combustion event, and operating the third cylinder of the engine with a rich combustion event.

The method may further include, for each lean combustion event, initiating combustion at a first timing, and for each rich combustion event, initiating combustion at a second timing, later than the first timing. In an example the engine may have an odd number of cylinders. In examples, operating the engine with the overall rich air-fuel ratio may include operating the engine so that exhaust gas entering the LNT has a rich air-fuel ratio. The method may further include, prior to the indication to regenerate the LNT, operating the engine with an overall lean air-fuel ratio, and responsive to the indication to regenerate the LNT and before the engine is operated with the overall rich air-fuel ratio, operating the engine with a stoichiometric air-fuel ratio. Operating the engine with the stoichiometric air-fuel ratio may include adjusting an intake throttle position to reduce a mass of air flow to the engine.

It will be appreciated by those skilled in the art that although the invention has been described by way of example with reference to one or more embodiments it is not limited to the disclosed embodiments and that alternative embodiments could be constructed without departing from the scope of the invention as defined by the appended claims.

Note that the example control and estimation routines included herein can be used with various engine and/or vehicle system configurations. The control methods and routines disclosed herein may be stored as executable instructions in non-transitory memory and may be carried out by the control system including the controller in combination with the various sensors, actuators, and other engine hardware. The specific routines described herein may represent one or more of any number of processing strategies such as event-driven, interrupt-driven, multi-tasking, multi-threading, and the like. As such, various actions, operations, and/or functions illustrated may be performed in the sequence illustrated, in parallel, or in some cases omitted. Likewise, the order of processing is not necessarily required to achieve the features and advantages of the example embodiments described herein, but is provided for ease of illustration and description. One or more of the illustrated actions, operations and/or functions may be repeatedly performed depending on the particular strategy being used. Further, the described actions, operations and/or functions may graphically represent code to be programmed into non-transitory memory of the computer readable storage medium in the engine control system, where the described actions are carried out by executing the instructions in a system including the various engine hardware components in combination with the electronic controller.

It will be appreciated that the configurations and routines disclosed herein are exemplary in nature, and that these specific embodiments are not to be considered in a limiting sense, because numerous variations are possible. For example, the above technology can be applied to V-6, I-4, I-6, V-12, opposed 4, and other engine types. The subject matter of the present disclosure includes all novel and non-obvious combinations and sub-combinations of the various systems and configurations, and other features, functions, and/or properties disclosed herein.

The following claims particularly point out certain combinations and sub-combinations regarded as novel and non-obvious. These claims may refer to "an" element or "a first" element or the equivalent thereof. Such claims should be understood to include incorporation of one or more such elements, neither requiring nor excluding two or more such elements. Other combinations and sub-combinations of the disclosed features, functions, elements, and/or properties may be claimed through amendment of the present claims or through presentation of new claims in this or a related application. Such claims, whether broader, narrower, equal, or different in scope to the original claims, also are regarded as included within the subject matter of the present disclosure.

The invention claimed is:

1. A method of operating a multi-cylinder lean burn engine arranged to supply exhaust gas to a lean NOx trap, the method comprising:

checking whether regeneration of the lean NOx trap is indicated and whether a current temperature of one of the lean NOx trap and exhaust gas supplied to the lean NOx trap is above a threshold temperature to permit efficient regeneration of the lean NOx trap;

when regeneration of the lean NOx trap is indicated and the current temperature of the exhaust gas supplied to the lean NOx trap is not greater than the threshold temperature, operating the engine in a lean NOx trap heating mode in which at least one cylinder of the engine is operated rich of stoichiometric in order to increase the current temperature of the lean NOx trap and at the same time operating at least one of the remaining cylinders of the engine lean of stoichiometric; and when regeneration of the lean NOx trap is indicated and the exhaust gas supplied to the lean NOx trap is above the threshold temperature, regenerating the lean NOx trap, wherein during the lean NOx trap heating mode, a number of cylinders of the engine operated rich and a respective air-fuel ratio of a mixture supplied to the rich cylinders of the engine and a number of cylinders of the engine operated lean and a respective air-fuel ratio of the mixture supplied to the lean cylinders of the engine are set so as to produce a commanded air-fuel ratio of the exhaust gas flowing to the lean NOx trap and to meet a current torque demand for the engine, where each of the number of cylinders of the engine operated rich and each of the number of cylinders operated lean are alternated between a rich air-fuel ratio to a lean air-fuel ratio pattern of two rich combustion events for every one lean combustion event at a same time across a plurality of engine cycles, where all cylinders of the engine are operated rich at some time during a period of time in which the engine is operated in the lean NOx trap heating mode, and where the engine is a three-cylinder engine.

2. The method as claimed in claim 1, wherein the engine has more than two cylinders, and wherein during the lean NOx trap heating mode, more than one cylinder of the engine is operated rich and more than one air-fuel ratio is used for the cylinders of the engine operating rich.

3. The method as claimed in claim 1, wherein the engine has more than two cylinders, and wherein during the lean NOx trap heating mode, more than one cylinder of the engine is operated lean and more than one air-fuel ratio is used for the cylinders of the engine operating lean.

4. The method as claimed in claim 1, wherein operating the engine in the lean NOx trap heating mode results in an air-fuel lambda ratio of the exhaust gas flowing to the lean NOx trap that is not less than one.

5. The method as claimed in claim 1, wherein the threshold temperature is a first threshold temperature, and wherein regenerating the lean NOx trap comprises heating the lean NOx trap to a second threshold temperature, higher than the first threshold temperature, to permit efficient NOx purge regeneration of the lean NOx trap, and supplying exhaust gas to the lean NOx trap having an air-fuel ratio less than one.

6. The method as claimed in claim 1, wherein the threshold temperature is a first threshold temperature, and wherein regenerating the lean NOx trap comprises heating the lean NOx trap to a second threshold temperature, higher than the first threshold temperature, to permit efficient DeSOx purge regeneration of the lean NOx trap, and switching an air-fuel lambda ratio of the exhaust gas flowing to the lean NOx trap between more than one and less than one in a cyclic manner during the DeSOx purge regeneration.

7. A method of reducing engine oil dilution of a multi-cylinder lean burn engine arranged to supply exhaust gas to a lean NOx trap during regeneration of the lean NOx trap, the method comprising:

operating the engine in an asymmetric combustion mode in which all cylinders of the engine are operated in an alternating rich and lean pattern at a same time to interrupt a transfer of fuel onto cylinder walls of the engine thereby resulting in a reduction in the transfer of fuel into oil of the engine, where operating the engine in the asymmetric combustion mode includes:

operating one or more cylinders of the engine rich while one or more cylinders of the engine are being operated lean, setting a number of cylinders of the engine being operated rich and a respective air-fuel ratio of a mixture supplied to each cylinder of the engine being operated rich, and setting a number of cylinders of the engine being operated lean and a respective air-fuel ratio of a mixture supplied to each cylinder of the engine being operated lean, so as to produce a demanded air-fuel ratio of exhaust gas flowing to the lean NOx trap and to meet a current torque demand for the engine, wherein the alternating rich and lean pattern comprises at least one of one rich combustion event followed by one lean combustion event and two rich combustion events followed by one lean combustion event.

8. The method as claimed in claim 7, wherein each cylinder is switched from lean operation to rich operation by increasing a mass of fuel supplied to that cylinder.

9. The method as claimed in claim 7, wherein each cylinder is switched from rich operation to lean operation by reducing a mass of fuel supplied to that cylinder.

10. The method as claimed in claim 7, wherein the one or more cylinders of the engine that are operated rich and the one or more cylinders of the engine that are operated lean are changed in a sequential pattern.

11. The method as claimed in claim 7, wherein all of the cylinders of the engine are operated rich at some time during the regeneration of the lean NOx trap.

12. The method as claimed in claim 7, wherein all of the cylinders of the engine are operated lean at some time during the regeneration of the lean NOx trap.

13. A method, comprising:

responsive to an indication to regenerate a lean NOx trap (LNT), operating an engine with an overall rich air-fuel ratio to regenerate the LNT while minimizing fuel oil dilution by operating each cylinder of the engine with an alternating rich to lean air-fuel ratio pattern of two rich combustion events for every one lean combustion event at a same time across a plurality of engine cycles.

14. The method of claim 13, wherein operating the engine with the overall rich air-fuel ratio to regenerate the LNT comprises, during each engine cycle where the engine is operated with the overall rich air-fuel ratio, operating two cylinders of the engine with a rich air-fuel ratio for every one cylinder of the engine operated with a lean air-fuel ratio.

15. The method of claim 13, wherein operating each cylinder of the engine with the alternating rich to lean air-fuel ratio pattern further comprises operating each cylinder of the engine such that consecutive lean combustion events for the engine as a whole are maintained under a first threshold and consecutive rich combustion events for the engine as a whole are maintained under a second threshold, higher than the first threshold.

16. The method of claim 13, wherein operating each cylinder of the engine with the alternating rich to lean air-fuel ratio pattern comprises:

during a first engine cycle, operating a first cylinder of the engine with a rich combustion event, operating a second cylinder of the engine with a lean combustion event, and operating a third cylinder of the engine with a rich combustion event;

during a second engine cycle immediately following the first engine cycle, operating the first cylinder of the engine with a rich combustion event, operating the second cylinder of the engine with the rich combustion event, and operating the third cylinder of the engine with a lean combustion event; and during a third engine cycle immediately following the second engine cycle, operating the first cylinder of the engine with the lean combustion event, operating the second cylinder of the engine with the rich combustion event, and operating the third cylinder of the engine with the rich combustion event.

17. The method of claim 16, further comprising, for each lean combustion event, initiating combustion at a first timing, and for each rich combustion event, initiating combustion at a second timing, later than the first timing.

18. The method of claim 13, wherein operating the engine with the overall rich air-fuel ratio comprises operating the engine so that exhaust gas entering the LNT has a rich air-fuel ratio, and wherein the engine has an odd number of cylinders.

19. The method of claim 13, further comprising:

prior to the indication to regenerate the LNT, operating the engine with an overall lean air-fuel ratio; and responsive to the indication to regenerate the LNT and before the engine is operated with the overall rich air-fuel ratio, operating the engine with a stoichiometric air-fuel ratio.

20. The method of claim 19, wherein operating the engine with the stoichiometric air-fuel ratio comprises adjusting an intake throttle position to reduce a mass of air flow to the engine.

* * * * *